US006408491B2

(12) United States Patent
Guyard

(10) Patent No.: US 6,408,491 B2
(45) Date of Patent: Jun. 25, 2002

(54) DEVICE FOR SECURING A WATCH STRAP TO A WATCH CASING

(75) Inventor: Jean-Pierre Guyard, Orchamps-Vennes (FR)

(73) Assignee: Conseils et Manufactures VLG SA, Neuchatel (CH)

( * ) Notice: Subject to any disclaimer, the term of this patent is extended or adjusted under 35 U.S.C. 154(b) by 0 days.

(21) Appl. No.: 09/732,870

(22) Filed: Dec. 11, 2000

(30) Foreign Application Priority Data

Feb. 25, 2000 (EP) ..... 00103952

(51) Int. Cl.[7] ..... G04B 37/16; A44B 11/25
(52) U.S. Cl. ..... 24/265 WS; 368/282
(58) Field of Search ..... 24/265 WS, 265 B; 368/282; 63/3.1, 4

(56) References Cited

U.S. PATENT DOCUMENTS

| | | | | |
|---|---|---|---|---|
| 3,908,243 A | | 9/1975 | Lou et al. | |
| 4,605,312 A | * | 8/1986 | Sellier | 368/282 |
| 5,483,505 A | * | 1/1996 | Cartier | 368/282 |
| 5,557,587 A | * | 9/1996 | Tosaka et al. | 368/282 |
| 6,014,793 A | * | 1/2000 | Howald | 24/265 B |

FOREIGN PATENT DOCUMENTS

| | | |
|---|---|---|
| CH | 614589 B5 | 12/1979 |
| DE | 9116677.2 | 9/1993 |
| FR | 2754434 A1 | 4/1998 |
| WO | WO9821630 | 5/1998 |
| WO | WO9936838 | 7/1999 |

* cited by examiner

*Primary Examiner*—Robert J. Sandy
(74) *Attorney, Agent, or Firm*—Young & Thompson

(57) ABSTRACT

The device for securing a watch strap to a watch casing comprises an intermediate element (1) to which is fixed the end of the watch strap (3), this intermediate element (1) being adapted to be received between the lugs (4) of the watch casing (2) by sliding in a complementary formation (10, 5) on the lateral surfaces of the intermediate element (1) and the internal surfaces of the lugs (4). The intermediate element (1) comprises a flap (11) pivoted about an axis (12) transverse to the watch strap and subject to a resilient action (15). This flap comprises a locking nose (16) coacting in service position with a locking surface (8) on the end surface of the watch casing (2). This nose 16 is applied by said resilient action (15) against this locking surface (8) when the intermediate element (1) is in the service position introduced between the lugs (4) of the casing (2).

6 Claims, 2 Drawing Sheets

DEVICE FOR SECURING A WATCH STRAP TO A WATCH CASING

BACKGROUND OF THE INVENTION

The present invention relates to securement devices for a watch strap on a watch casing, in particular a metallic or non-metallic watch strap, of leather or rubber for example.

There are known devices for the securement of a watch strap on a watch casing, for example from WO 98/21630; WO 99/36838 and CH 614,589. WO 98/21630 discloses a bracelet conventionally fixed on an intermediate element which is itself received between the lugs of the watch casing and is fixed to the latter with the help of a pin. Despite the presence of the intermediate element, the mounting and unmounting of the watch strap requires use of a tool to withdraw or push back the pin connecting it to the lugs of the casing.

The drawback of such a securement arises from the need to have recourse to a tool for changing the watch strap and also because the securement pin of the watch strap on the intermediate element as well as the pin fixing this intermediate element on the lugs of the watch casing, remain visible and detract from the appearance of the timepiece.

WO 99/36838 discloses a device for rapid securement without a tool, of a watch strap on a watch casing. This device comprises a first intermediate element mounted on the watch casing and that can slide or turn relative to this watch casing. A second intermediate element to which is fixed the watch strap, can engage the first intermediate element when the latter is in a mounting position relative to the watch casing. In normal service position of this first intermediate element relative to the watch casing, the second intermediate element is locked in a position coupled to the first intermediate element.

This embodiment is complicated, is not easily adaptable to secure metallic watch straps and does not prevent accidental uncoupling of the first and second intermediate elements.

The third document, Swiss patent CH 614,589, discloses a watch casing whose lugs are provided with hinges, having a longitudinal recess open at the end and on the internal surface of the hinge. The bracelet is fixed to a transverse bar whose cross section has the shape of a truncated cylinder permitting in a predetermined angular position to be introduced into the recess of the hinge of the watch casing. For all the other angular positions of this bar relative to the hinge, this bar is trapped in the hinge. Here again, the watch strap can inadvertently separate from the watch casing.

SUMMARY OF THE INVENTION

The object of the present invention is to permit rapid and reliable securement without a tool, of a watch strap of any type on a watch casing, whilst avoiding accidental and untimely separation of the watch strap from the watch. It is also an object of the present invention to provide a securement device for a watch strap on a watch casing, which has no visible element or mechanism and which does not detract from the appearance of the piece.

Another object is to permit the sale of all types of bracelets alone, in the form of accessories, which the user can simply mount himself on the watch casing without a tool, which will avoid any inadvertent separation.

The present invention has for its object a device for securement of a watch strap on a watch casing comprising the characteristics set forth in claim 1.

BRIEF DESCRIPTION OF THE DRAWINGS

The accompanying drawing shows schematically and by way of example an embodiment of the device for securing a watch strap on a watch casing, according to the invention.

DESCRIPTION OF THE PREFERRED EMBODIMENTS

Figure 1:
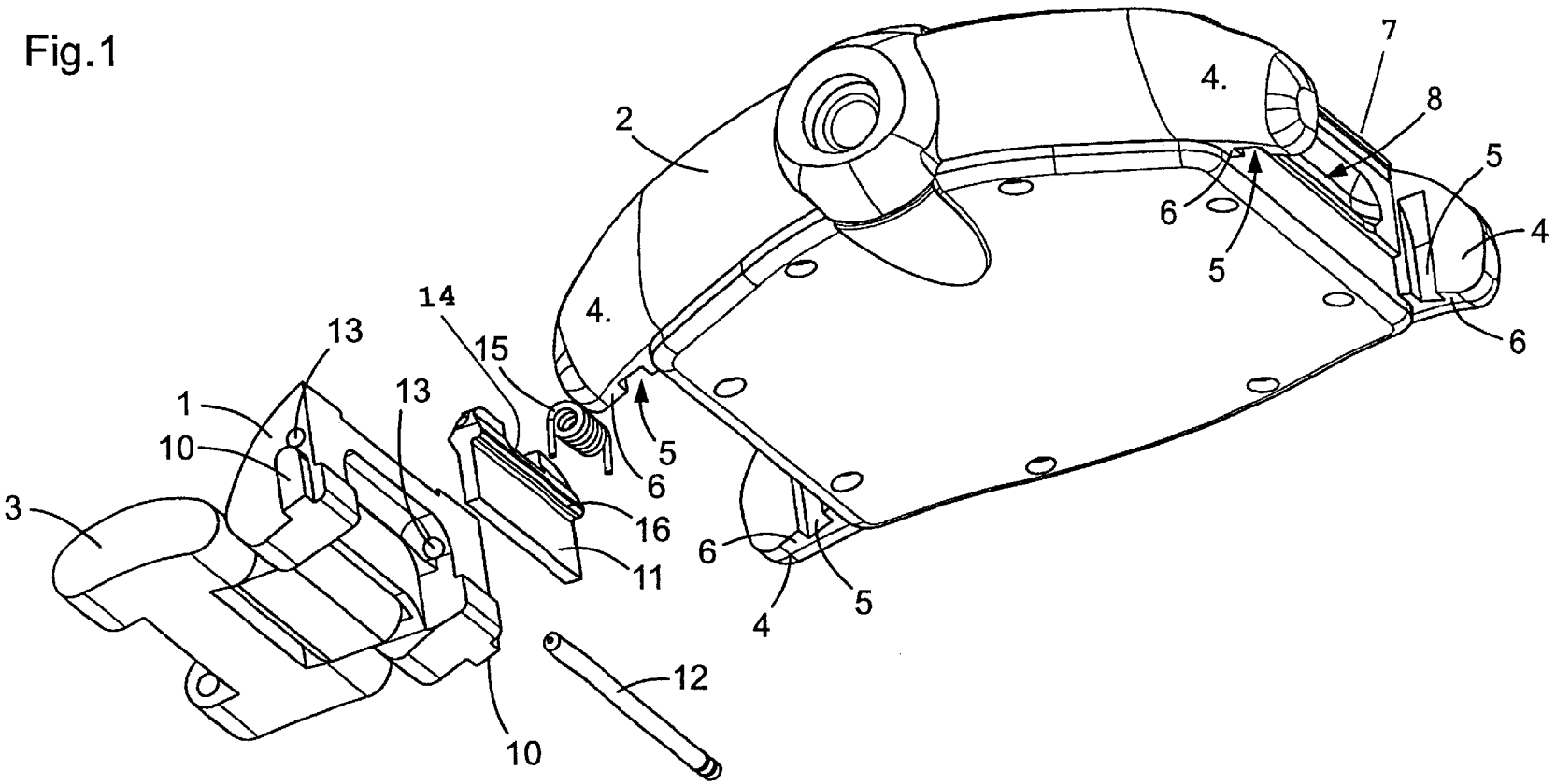
FIG. 1 is an exploded perspective view of the securement device.
Figure 3:
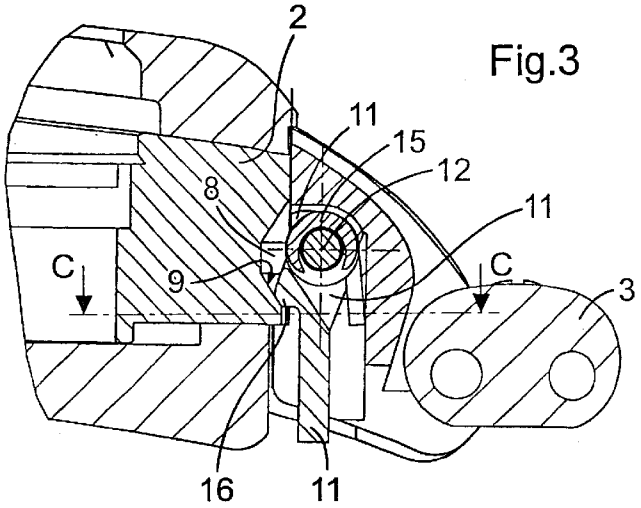
FIG. 3 is a cross section on a larger scale on the line A—A of FIG. 2.
Figure 5:
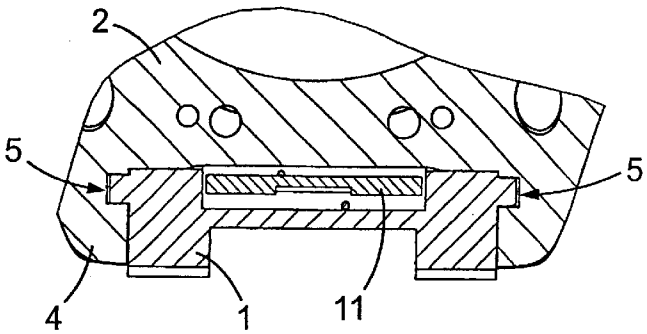
FIG. 5 is a cross section on a larger scale on the line C—C of FIG. 3.
Figure 2:
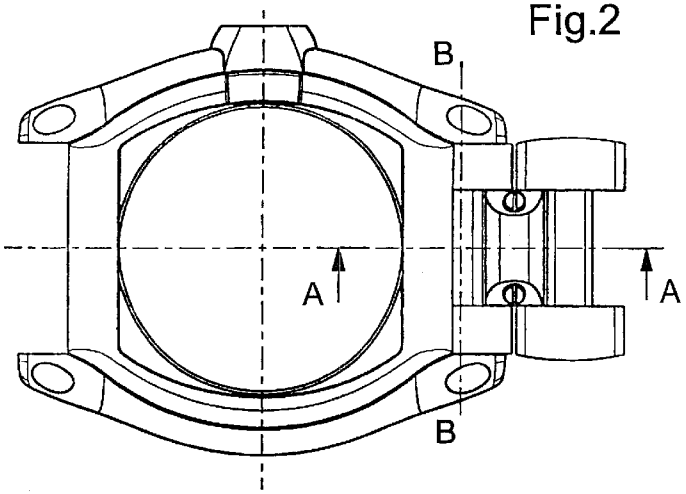
FIG. 2 is a plan view of a watch assembled to a watch strap with the aid of the securement device.
Figure 4:
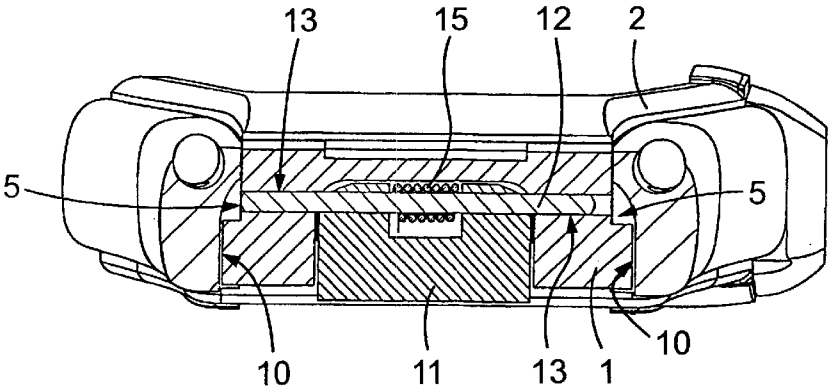
FIG. 4 is a cross section on a larger scale on the line B—B of FIG. 2.

The securement device according to the invention comprises an intermediate element 1 on which is secured in a conventional manner the end of a leather or metal watch strap, this intermediate element being shaped so as to be coupled to the watch casing 2.

In the illustrated example, the intermediate element 1 is coupled to the last link 3 of a metallic watch strap with the help of a pin for example whose ends are not visible from outside the link 3.

The watch casing 2 is provided with lugs 4 which have in their facing surfaces grooves 5 opening on the lower surface 6 of these lugs 4 but not opening on the upper surface of these lugs 4. The end surfaces 7 of the watch casing 2 or of its body have, between the lugs 4, a recess 8 delimited downwardly by an inclined locking surface 9.

The intermediate element 1 is formed from a block having generally the shape of the space comprised between two lugs 4 of the casing 2. On these lateral surfaces, this intermediate element 1 comprises ribs 10 adapted to engaging grooves 5 of the lugs 4 when it is coupled to the casing 2.

In the position coupled to the casing 2, this intermediate element 1 occupies the space between the lugs 4 and permits giving the casing-watch strap assembly the desired appearance.

This intermediate element has a recess opening on its lower surfaces and its surface directed toward the end surface of the casing 2 in which a locking flap 11 is pivotably mounted about a pin 12 whose ends are disposed in holes 13 in the intermediate element 1. The locking flap 11 comprises a recess 14 in which is located a coil spring 15, surrounding the central portion of the pin on which is articulated the locking flap 11 and whose ends bear, in the service position of the intermediate element 1 in which position it is coupled to the lugs 4 of the casing 2, one against said flap and the other against the locking surface 9 of the casing 2. This spring 15 tends to apply against the locking surface 9 of the casing 2 a locking nose 16 on the flap 11.

Thus, when the intermediate element 1 is engaged fully between the lugs 4 of the casing 2, the locking nose 16 of the flap 11 is applied against the locking surface 9 of the casing 2 by the spring 15 and this intermediate element 1 cannot untimely or involuntarily separate from the casing 2.

To separate the intermediate element from the casing, and hence to disassemble the watch strap from this casing, possibly for changing the watch strap, it is necessary that the user move the flap 11 in the direction of the end surface of the casing 2 such that the locking nose 16 will be withdrawn from the locking surface 9 of the casing. Only after having actuated the flap 11 can the intermediate element 1 be separated from the casing 2.

As will be seen, this securement device is very simple, robust, and easy to machine. It permits coupling and uncoupling of the watch strap from the watch casing easily and without any tool, but, because of the locking, it prevents any untimely or involuntary separation of the intermediate element 1 from the casing 2.

Moreover, no coupling and locking mechanism members are visible from above or from the side of the watch casing of the watch strap. In practice, interchangeable watch straps can be sold, coupled to an intermediate element 1 so as to be able, without a tool and very simply, by the user himself, to interchange the watch straps.

It is evident that this device can be used for the securement of any type of metallic, non-metallic, leather, plastic material, rubber, etc. watch strap.

The watch strap of no matter what type is fixed in a conventional manner to the intermediate element described above and can be removably secured to the watch casing.

What is claimed is:

1. A device for securing a watch strap on a watch casing, comprising:

an intermediate element adapted to be secured to an end of the watch strap, this intermediate element being adapted to be received between lugs of the watch casing by slideably engaging a complementary formation on lateral surfaces of the intermediate element and internal surfaces of the lugs; and a flap pivoted about an axis transverse to the watch strap and subject to resilient action, this flap comprising a locking nose coacting with a locking surface on an end surface of the watch casing, this nose being applied by said resilient action against said locking surface when the intermediate element is between the lugs of the casing.

2. The device according to claim 1, wherein the complementary formation comprises ribs on lateral surfaces of the intermediate element coacting with grooves in the internal surfaces of the lugs.

3. The device according to claim 1, wherein the end surfaces of the casing comprise recesses comprising an inclined locking surface.

4. The device according to claim 1, wherein the resilient action is constituted by a coil spring disposed about the pivotal axis of the flap.

5. The device according to claim 1, wherein an upper surface of the intermediate element is located in prolongation of upper surfaces of the lugs when the intermediate element is between the lugs.

6. A watch strap, comprising at least one intermediate element fixed to at least one end of the watch strap and having lateral surfaces slideways adapted to be received slidably in corresponding formations on lateral internal surfaces of lugs of a watch casing, the intermediate element comprising a flap pivoted about an axis transverse to the watch strap and subject to resilient action, this flap comprising a locking nose coacting with a locking surface on an end surface of the watch casing, this nose being applied by said resilient action against said locking surface when the intermediate element is between the lugs of the watch casing.

* * * * *